United States Patent [19]

Iversen et al.

[11] Patent Number: 4,540,230

[45] Date of Patent: Sep. 10, 1985

[54] WEATHERPROOF HERMETICALLY SEALED CONNECTOR DEVICE

[75] Inventors: Ralph Iversen, Granada Hills; Dewey F. Harris, Pasadena, both of Calif.

[73] Assignee: Whittaker Corporation, Los Angeles, Calif.

[21] Appl. No.: 565,301

[22] Filed: Dec. 27, 1983

[51] Int. Cl.[3] ..... H01K 13/62

[52] U.S. Cl. ..... 339/89 M; 339/94 M

[58] Field of Search ..... 339/177, 94, 89, 90

[56] References Cited

U.S. PATENT DOCUMENTS

| | | | |
|---|---|---|---|
| 2,655,638 | 10/1953 | Allen | 339/94 M |
| 3,017,597 | 1/1962 | Nava et al. | 339/94 M |
| 3,223,959 | 12/1965 | Abbott | 339/94 M |
| 3,336,569 | 8/1967 | Nava | 339/94 M |
| 3,594,701 | 7/1971 | Ramsey | 339/94 R |
| 3,659,250 | 4/1972 | Horton | 339/94 R |
| 4,402,566 | 9/1983 | Powell et al. | 339/94 M |

*Primary Examiner*—Gil Weidenfeld
*Assistant Examiner*—David L. Pirlot
*Attorney, Agent, or Firm*—Donald E. Nist

[57] ABSTRACT

The connector device comprises a male plug and a female receptacle, each of which has a housing with a central tubular component and a cavity extending therethrough and adapted to receive an end of an electrical conduit. Both the plug and receptacle include means for aligning the electrical pathways therein and for sealing the conduits, plug and receptacle against elevated temperature and corrosive gases, etc. The central tubular components are electrically insulated. The male plug has a plurality of spaced parallel connector pins extending forwardly from the front end of the plug's tubular component and spaced inwardly of a plug sleeve. The receptacle tubular member is disposed within a sleeve and carries a pin receiver on the front end thereof, which receiver bears a plurality of spaced parallel passageways extending longitudinally of the tubular member and containing electrical connectors therein for interconnection with an electrical conduit at the rear of the female receptacle. The male plug sleeve is receivable within the female sleeve and sealing means in the male plug and female receptacle include spaced O-rings or equivalent graphite seals to provide double hermetic sealing protection. Moreover, the male plug connector pins sealingly engage the female receptacle passageways. Critical seal dimensions are obviated because the telescoping of the sleeves provides dynamic sealing of the device. Locking means are also provided to help hold the male and female components together. The device is simple, inexpensive, durable and effective.

3 Claims, 4 Drawing Figures

WEATHERPROOF HERMETICALLY SEALED CONNECTOR DEVICE

BACKGROUND OF THE INVENTION

1. Field of the Invention

The present invention generally relates to electrical components and more particularly to an improved thermal and corrosion resistant positive sealing connector device for electrical conduits.

2. Prior Art

Conduit connectors for various specialty applications, such as nuclear reactors, and high frequency electronic components frequently are required to afford protection of the conduits against heat, corrosive gases and liquids, moisture and the like. However, such connectors normally are not properly designed to provide such protection over any reasonable length of time. Those connectors which employ male and female components also are frequently difficult to properly align and to attach to the conduit ends so that much time is wasted in installing, replacing and repairing such connectors. In many applications repeated movement of the connectors, for example when used in vibrating vehicles and the like, results in loosening of the connector components, thereby permitting breach of the thermal and corrosion seals and eventually impairing the electrical connection provided by the connector.

There is currently a need for a simple, relatively inexpensive, highly efficient electrical conduit connector which hermetically seals the conduit ends and connector components against corrosion, heat and other adverse conditions and which provides a wide margin of safety against loosening of the components thereof by vibration during use. Such a connector should be easily welded or otherwise installed on stainless steel jacketed coaxial cables and the like. It should be adaptable for use in nuclear reactors and in high frequency microwave applications.

SUMMARY OF THE INVENTION

The improved weatherproof hermetically sealed connector device of the present invention satisfies all of the foregoing needs. The connector device is substantially as set forth in the Abstract above. Thus, it comprises a male plug and female receptacle, each having a housing with a central tubular electrically insulated component therein. Each such tubular component has a cavity extending longitudinally therein, in which an electrical conduit is adapted to be sealingly received. When the plug and receptacle are joined together, electrical conduit ends disposed therein are electrically interconnected and effectively protected against corrosion, atmospheric conditions and heat, due to the multiple longitudinally spaced sealing elements disposed within the telescoping sleeves of the plug and receptacle.

The front end of the central tubular component of the male plug contains a plurality of spaced parallel pins extending forwardly therefrom within the open ended plug sleeve. These pins are adapted to be aligned with and extend in sealing engagement within corresponding passageways in a pin receiver in the front end of the central tubular member in the female receptacle. The passageways are provided with electrical connector means to establish the necessary interconnection with an electrical conduit when it is positioned at the rear of the female receptacle. The male sleeve slides within the female sleeve during connection of the plug and receptacle and sealing means, preferably in the form of spaced O-rings, are carried by the plug sleeve and/or female central tubular component and/or female sleeve to assure an hermetic seal at a plurality of points between the plug and receptacle, doubly protecting the central tubular components against entry of heat, atmosphere and corrosive conditions. The pins and passageways as well as the sleeves and seals help to hold the plug and receptacle together in sealing engagement even when the two components are not locked together as by threaded screw means or the like. Thus, the device functions effectively even in conditions where it is subjected to vibrations and the like.

Further features of the present invention are set forth in the following detailed description and accompanying drawings.

DRAWINGS

DETAILED DESCRIPTION

FIGS. 1–4

Figure 1:
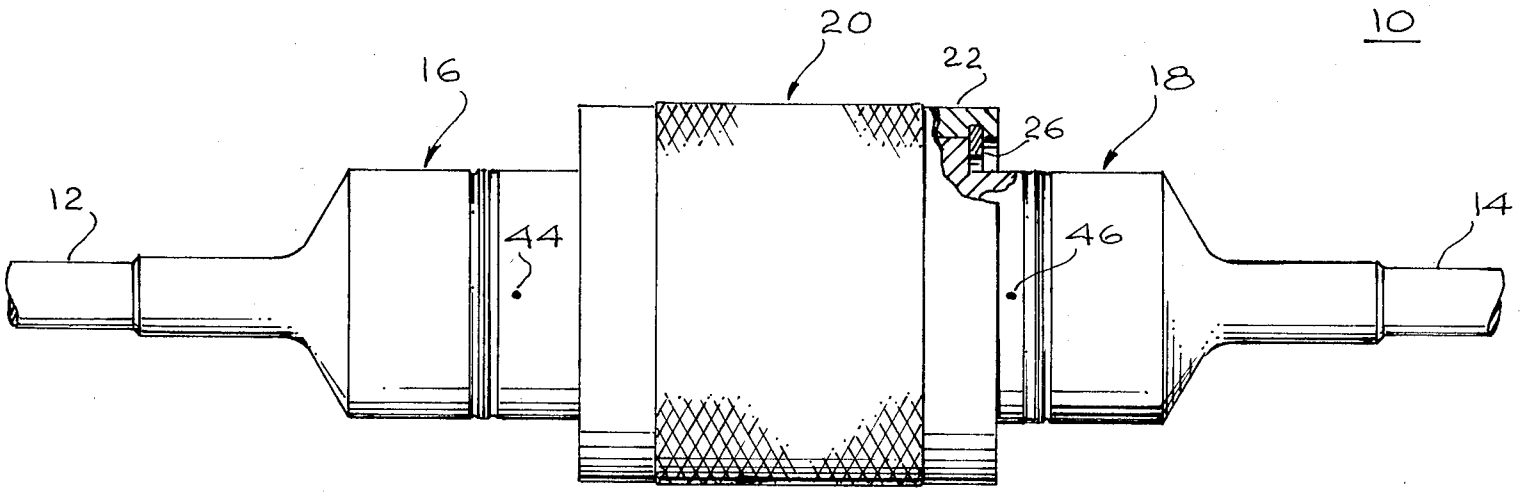
FIG. 1 is a schematic side elevation partly, broken away, of a preferred embodiment of the improved hermetically sealed connector device of the present invention, shown connected to two cable ends.

Now referring more particularly to FIG. 1 of the accompanying drawings, a preferred embodiment of the improved hermetically sealed connector device of the present invention is schematically depicted therein. Thus, connector device 10 is shown connected to cable ends 12 and 14, as by welding, brazing or the like. Device 10 comprises a male plug component 16 releasably secured to a female receptacle component 18, as by a locking device 20 which includes a knurled internally threaded sleeve 22.

Figure 2:
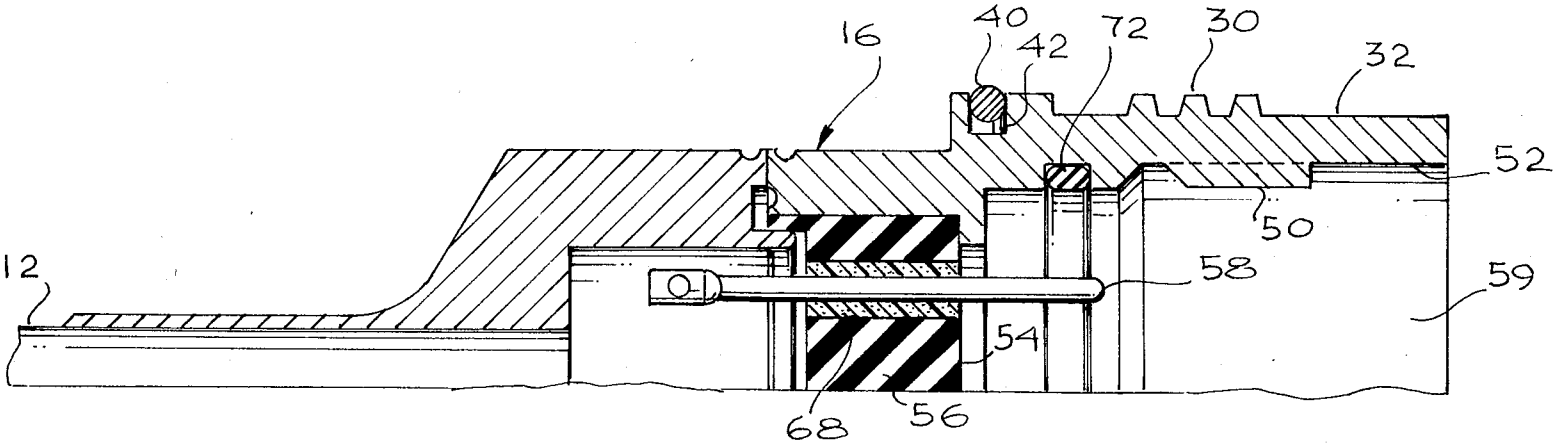
FIG. 2 is a schematic vertical cross-section of the upper half of the male plug component of the improved hermetically sealed connector device of FIG. 1.
Figure 3:
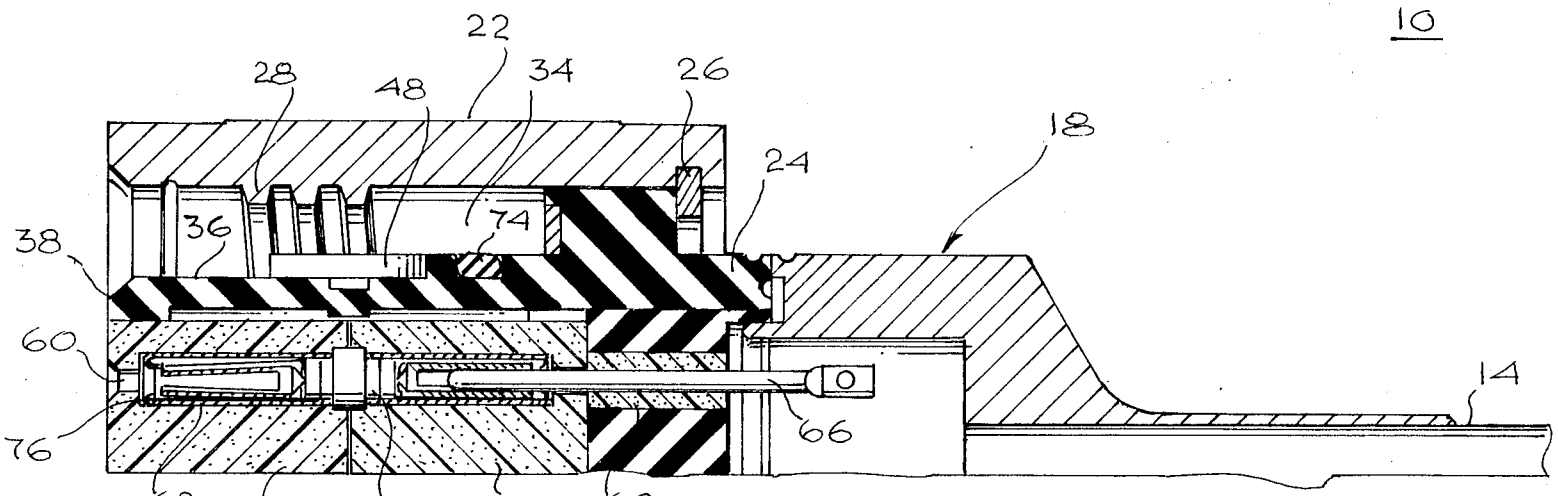
FIG. 3 is a schematic vertical cross-section of the upper half of the female receptacle component of the improved hermetically sealed connector device of FIG. 1; and, FIG. 4 is a vertical section of the upper half of a portion of each of the male plug and female receptacle components of the improved hermetically sealed connector device of FIG. 1, shown aligned with each other.

As shown particularly in FIG. 3 of the drawings, sleeve 22 forms part of receptacle component 18, and is secured to a central tubular member 24 of component 18 by a retainer ring 26 so that sleeve 22 freely rotates around member 24. The internal threads 28 of sleeve 22 releasably engage external threads 30 of male plug component 16 (FIG. 2) when the forward cylindrical sleeve portion 32 of component 16 is inserted in a forward annular space 34 in receptacle component 18, which space is defined by sleeve 22 and the peripheral surface 36 of the front portion 38 of component 18. A C-shaped retainer spring 40 disposed in a groove 42 in the exterior surface of plug portion 16 aids in releasably locking sleeve 22 to portion 16 to prevent it from unlocking even when device 10 is subjected to substantial vibration.

In order to facilitate alignment of plug 16 for insertion into receptacle 18, alignment dots or marks 44 and 46 may be provided in the outer surface of plug 16 and receptacle 18, respectively. The front portion 38 of receptacle 18 may also be provided with longitudinally extending aligning slots 48 adapted to receive detents 50 in the inner surface 52 of sleeve 32.

Figure 4:
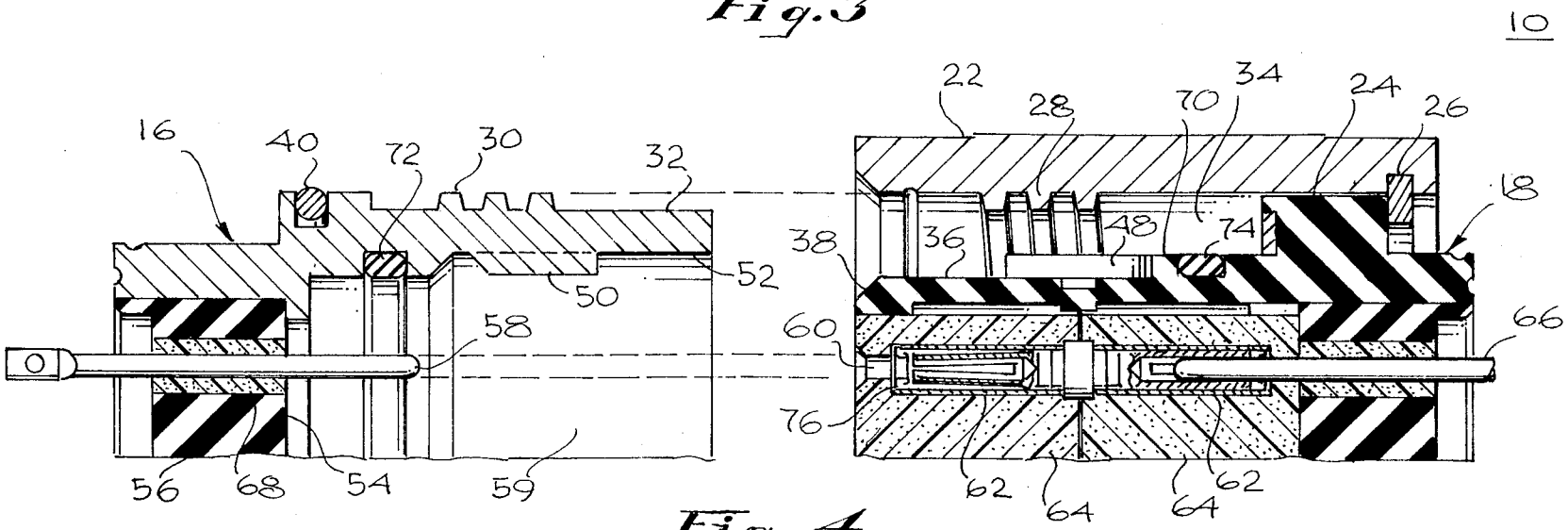

Moreover, the front portion 54 of the central tubular component 56 forming the bulk of plug 16 is provided with a plurality of forwardly extending, spaced, parallel electrically conductive pins 58. Pins 58 extend forwardly into the space 59 which is in front of portion 54 and is defined by sleeve 32, as shown in FIGS. 2 and 4. Pins 58 are dimensioned and aligned such that when sleeve 32 is moved into full locked engagement with receptacle 18 so that it is extended fully forwardly in space 34, pins 58 are fully received in spaced parallel passageways 60 in portion 38, which comprises a pin receiver. Pins 58 when fully engaged in passageways 60 are firmly gripped by the internal electrically conductive linings 62 provided in passageways 60. Linings 62 spring grip pins 58 and cooperate therewith to help hold plug 16 and receptacle 18 together when fully engaged even if locking sleeve is not fully locked to plug 16.

Passageways 60 extend longitudinally through a central thermally insulative core 64 of member 24, which core is of a dielectric ceramic material or the like. Passageways 60 are lined throughout with electrically conductive linings 62 and are provided with rear pins 66 of ferrous alloy or the like electrically conductive material which extend into electrical communication with cable 14. Similarly, pins 58 extend longitudinally through a central thermally insulative core 68 of dielectric ceramic or the like in component 56 and into electrical communication with cable 12.

It will be understood that when plug 16 and receptacle 18 are fully engaged, the front portion 38 and the middle portion 70 of tubular member 24 extend into and are received within space 59 of plug 16. In such a position, a first O-ring or other annular seal 72 of resilient rubber, plastic or the like disposed in the inner surface 52 of sleeve 32 engages the outer periphery 36 of front portion 38 of tubular member 24 to seal plug 16 to receptacle 18. Moreover, a second annular seal such as a resilient O-ring 74 disposed in the outer surface of the middle portion 70 of tubular member 24 engages the inner surface 52 at the front end of sleeve 32 to additionally seal plug 16 and receptacle 18 together. These two longitudinally spaced separate seals provide the desired positive sealing of the connector device 10 so that it is impervious when in the fully engaged position to heat, moisture, corrosive gases, etc. Because pins 58 fit firmly into linings 62, this seal is additionally positive. The positive locking nature of lock 20 adds a fourth form of assurance that the desired seal will not be breached and that the electrical conductivity provided by connector 10 will not be impaired, whereby cables 12 and 14 will stay in full electrical contact with each other.

Linings 62 may be provided with a napkin split ring type of spring configuration and may be further provided with a protective hood portion having an inwardly rolled front end 76 to serve as a pin alignment guide. Linings 62 and their component parts can be fabricated of any suitable electrically conductive material which affords the desired spring gripping effect. Such material can include ferrous or non-ferrous metal alloys or the like. The hood 76 can be, for example, of stainless steel as can sleeve 32, sleeve 22, the main bulk of plug 16 and receptacle 18 and those parts of tubular members 24 and 56 which are peripheral of central thermally insulative cores 64 and 68.

Plug 16 and receptacle 18 can be readily soldered or brazed to cables 12, the ends of which are receivable therein and connectible to pins 58 and 66 as previously described. Once cables 12 and 14 are electrically connected to plug 16 and receptacle 18, those two components can be easily aligned with each other, as shown in FIG. 4, by reference to the marks 44 and 46 (FIG. 1) and then fully engaged so that pins 58 fit fully into passageways 60, with linings 62 firmly gripping them. Locking sleeve 22 is then rotated forward until plug 16 is locked to receptacle 18, spring 40 helping to maintain sleeve 22 in the fully locked position. Plug 16 and receptacle 18 can be just as easily unlocked and uncoupled merely by reversing this procedure.

The ease of alignment of plug 16 with receptacle 18 and the ease of locking and unlocking these two components facilitates their use in such applications as nuclear reactors and the like where many connections may be required and coupling and uncoupling of of connectors are called for. Most importantly, connector 10 provides a multiple seal protective system to assure that it is fully insulated against heat, corrosion and moisture conditions and that it will not uncouple even when subjected to vibration in use. Thus device 10 is simple, effective, durable and efficient, and can result in a great saving of time and effort and thus a great saving in expense when used for the installation and maintenance of a plurality of cables as in nuclear reactors and other power devices which are particularly subject to corrosive high temperature environments. Device 10 can be fabricated from easily available conventional materials and has other features and advantages as set forth in the foregoing.

Various modifications, changes, alterations and additions can be made in the improved method of the present invention, its steps and parameters. All such modifications, changes, alterations and additions as are within the scope of the appended claims form part of the present invention.

What is claimed is:

1. An improved weatherproof, hermetically sealed connector device for electrical conduits, said device comprising, in combination:

a. a male plug comprising a housing having
   i. a central electrically insulative tubular component having a cavity extending therethrough adapted to receive an electrical conduit at the rear end thereof,
   ii. a plurality of spaced parallel connector pins disposed in a substantially circular array and extending forwardly from the front end of said tubular component,
   iii. a sleeve concentric with and peripheral of said pins and having an inner surface to define with said pins a peripheral space therebetween, and
   iv. sealing means comprising an O-ring disposed in a recess in said sleeve inner surface and around said tubular component for hermetically sealing said tubular component against atmospheric conditions;

b. a female receptacle comprising a housing having
   i. a central electrically insulative tubular member having a cavity extending therethrough adapted to receive an electrical conduit at the rear end thereof,
   ii. a pin receiver on the front end of said tubular member and bearing a plurality of spaced, parallel connector pin-receiving passageways extending longitudinally of said central tubular member and electrical connector means therein for interconnection with an electrical conduit at said rear end thereof, said passageways being aligned with said plug pins and adapted to thermal sealingly engage therewith;

iii. a sleeve concentric with and peripheral of said tubular member to define a peripheral space therebetween, said male plug sleeve being receivable within said female sleeve, iv. locking means connected to said female sleeve to releasably secure said male plug and female receptacle together; and, v. sealing means comprising an O-ring disposed in a recess in the outer surface of said tubular member for hermetically sealing said female receptacle against atmospheric conditions, said plug and receptacle O-rings being spaced apart longitudinally when said male plug and female receptacle are fully engaged, both O-rings engaging the opposing outer surface of said central tubular member and inner surface of said plug sleeve, whereby double hermetic sealing protection is provided.

2. The improved device of claim 1 wherein when said male plug and female receptacle are fully engaged, said first of said O-rings engages the outer surface of said central tubular member adjacent the front thereof and said second of said O-rings engages the inner surface of said male plug sleeve adjacent the front end thereof.

3. The improved device of claim 1 wherein said male plug and said female receptacle are generally cylindrical and wherein said cavities in said tubular component and tubular member are adapted to receive the ends of electrical cable.

* * * * *